US008528733B2

(12) United States Patent
D'Hollander

(10) Patent No.: US 8,528,733 B2
(45) Date of Patent: Sep. 10, 2013

(54) GIFT PACKAGING CONTAINER

(76) Inventor: Frank D'Hollander, Antwerp (BE)

( * ) Notice: Subject to any disclaimer, the term of this patent is extended or adjusted under 35 U.S.C. 154(b) by 0 days.

(21) Appl. No.: 13/417,872

(22) Filed: Mar. 12, 2012

(65) Prior Publication Data

US 2013/0186796 A1 Jul. 25, 2013

Related U.S. Application Data

(63) Continuation-in-part of application No. 29/411,546, filed on Jan. 23, 2012, and a continuation-in-part of application No. 29/411,547, filed on Jan. 23, 2012, and a continuation-in-part of application No. 29/411,548, filed on Jan. 23, 2012.

(51) Int. Cl.
*B65D 73/00* (2006.01)

(52) U.S. Cl.
USPC ..... 206/457

(58) Field of Classification Search
USPC ..... 206/457, 459.5, 775, 776, 778, 781; 53/167, 396; 446/71, 72, 73, 74, 77
See application file for complete search history.

(56) References Cited

U.S. PATENT DOCUMENTS

| | | | | |
|---|---|---|---|---|
| 2,544,594 | A * | 3/1951 | Goldfarb | 446/74 |
| 3,166,839 | A * | 1/1965 | Dock et al. | 29/422 |
| 3,296,735 | A * | 1/1967 | Djedda | 446/72 |
| 3,910,408 | A * | 10/1975 | Husney et al. | 206/81 |
| 5,013,278 | A * | 5/1991 | Dixon et al. | 446/73 |
| 5,261,848 | A * | 11/1993 | Kaplan et al. | 446/74 |
| 5,292,003 | A * | 3/1994 | Baghdassarian | 206/575 |
| 5,375,828 | A * | 12/1994 | Shikami | 273/110 |
| 5,673,789 | A * | 10/1997 | Degraff-Eugene | 206/217 |
| 6,299,014 | B1 * | 10/2001 | Nava et al. | 220/521 |
| 6,464,078 | B1 * | 10/2002 | Grossnickle | 206/459.5 |
| 6,766,902 | B1 * | 7/2004 | Hartelius | 206/217 |
| 2005/0011095 | A1 * | 1/2005 | Ridenour et al. | 40/564 |

* cited by examiner

*Primary Examiner* — Jacob K Ackun

(74) *Attorney, Agent, or Firm* — Banner & Witcoff Ltd.

(57) ABSTRACT

A packaging container is disclosed that includes a lid, a transparent material mounted on top of the lid that encloses an interior space, an article of artwork positioned inside the interior space and a transparent medium that fills substantially all or all of the remaining interior space, and a base below the lid with a storage cavity. In addition, a method for packaging a gift is disclosed that includes placing the gift in a storage cavity of a packaging container that includes a lid, a transparent material mounted on top of the lid that encloses an interior space configured to house at least one article of artwork and a base below the lid with a storage cavity, positioning at least one article of artwork inside the interior space and filling substantially all or all of the remaining interior space with a transparent medium.

1 Claim, 6 Drawing Sheets

GIFT PACKAGING CONTAINER

This application is a continuation-in-part of U.S. Design patent application Ser. No. 29/411,546, U.S. Design patent application Ser. No. 29/411,547 and U.S. Design patent application Ser. No. 29/411,548, each of which were filed on Jan. 23, 2012, where each of these applications are incorporated by reference in their entirety into the present application as if fully set forth herein.

FIELD OF THE INVENTION

This invention relates to packaging containers. In particular, this invention relates to an apparatus and method for packaging gifts.

BACKGROUND

Gifts are commonly packaged in such a way that the type of gift or content of a gift is not readily apparent to the recipient, meaning the recipient must then open the packaging in the appropriate matter to reveal the gift. Typical gift packaging often consists of opaque paper or material that is solely present to temporarily obfuscate the contents of the gift contained therein before being discarded. Even when a gift has significant value, for example a gift card or gift voucher, unattractive or minimalist packaging such as plain paper or an envelope may lower the initial perceived value of, or appreciation for, the gift.

To provide a more lasting reminder of the gift or increase the initial appreciation for the gift, however, it may be desirable to utilize packaging that the recipient will keep in addition to the gift. Specifically, it would be desirable to utilize packaging that can serve as a stand-alone, aesthetically pleasing reminder of the gift itself or the occasion where the gift was granted. It may also be desirable to utilize gift packaging that alludes to the contents therein, thus heightening the anticipation of the recipient.

It is an object of the invention to provide gift packaging containers that, amongst other features and advantages, address these objectives. It is an object of certain embodiments of the invention to provide a gift packaging container. It is an object of certain other embodiments of the invention to provide a method for packaging gifts. These and other objects, features and advantages of the invention or of certain embodiments of the invention will be apparent to those skilled in the art from the following disclosure and description of exemplary embodiments.

SUMMARY

In accordance with one aspect of the invention, a packaging container is provided that includes a lid comprising an exterior surface and an interior surface, a transparent material mounted on top of at least part of the exterior surface of the lid, wherein the transparent material encloses an interior space configured to house at least one article of artwork, an article of artwork positioned inside the interior space enclosed by the transparent material, a transparent medium filling substantially all or all of the remaining interior space enclosed within the transparent material and a base disposed below the lid, wherein a portion of the base meets the interior surface of the lid and wherein at least a portion of the base defines a storage cavity. In certain embodiments, the packaging container further comprises an opener.

In some exemplary embodiments of the invention the storage cavity has a size and shape configured to receive and store a gift card. In certain embodiments, the article of artwork indicates the type of goods or services provided by a gift card, such as a gift card contained inside the storage cavity. In certain other embodiments the article of artwork indicates the brand or store name from which a gift card, such as a gift card contained inside the storage cavity, originates. In yet other embodiments the article of artwork is related to the theme of an occasion, for instance the occasion where the packaging container is given to a recipient.

In other exemplary embodiments of the invention, the base further comprises a writeable surface attached to a surface of the base or a surface of the storage cavity.

In still other exemplary embodiments of the invention the storage cavity has a size and shape configured to receive and store one or more goods and the article of artwork indicates a type of goods, indicates a brand or store name or is related to the theme of an occasion.

In yet other exemplary embodiments, the storage cavity has a size and shape configured to receive and store paper currency.

In certain embodiments of the invention, some or all of the transparent material is spherically shaped such that at least part of the enclosed interior space is spherical in shape. In some exemplary embodiments the transparent medium that substantially or completely fills the remaining enclosed interior space is water, oil, glycerine or a combination thereof.

In some other exemplary embodiments, the packaging container further comprises a plurality of particles dispersed within the transparent medium, in certain of these embodiments the plurality of particles are made of plastic, porcelain or metallic foil.

In yet other exemplary embodiments, the packaging container further comprises at least one side displaying exterior artwork or having exterior artwork attached, wherein the exterior artwork is related to the article of artwork positioned inside the transparent material.

In certain exemplary embodiments of the invention, the article of artwork is a figure, photograph or a representation of a landscape.

In still other exemplary embodiments, a packaging container is provided that includes a lid comprising an exterior surface and an interior surface, a transparent material mounted on top of at least part of the exterior surface of the lid, wherein some or all of the transparent material is spherically shaped such that it encloses an interior space that is at least in part spherical in shape, and wherein the interior space is configured to house at least one article of artwork, an article of artwork positioned inside the interior space enclosed by the transparent material, wherein the article of artwork indicates a type of goods or services, a brand or store name or is related to the theme of an occasion, a transparent medium filling substantially all or all of the remaining interior space enclosed within the transparent material, a base disposed below the lid, wherein a portion of the base meets the interior surface of the lid and wherein at least a portion of the base defines a storage cavity having a size and shape configured to receive and store a gift card, a writeable surface attached to a surface of the base or a surface of the storage cavity and a hinge or bearing connecting the lid and base.

Other aspects of the invention relate to a method for packaging gifts. In some exemplary embodiments, the method includes placing a gift in a storage cavity of a packaging container, where the packaging container comprises a lid comprising an exterior surface and an interior surface, a transparent material mounted on top of at least part of the exterior surface of the lid that encloses an interior space configured to house at least one article of artwork, and a base disposed below the lid, wherein a portion of the base meets the interior surface of the lid, and wherein at least a portion of the base defines the storage cavity, positioning an article of artwork inside the interior space enclosed within the transparent material, wherein the article of artwork indicates the type of goods or services provided by the gift, indicates the brand or store name from which the gift originates or is related to the theme of an occasion, and filling substantially all or all of the remaining interior space enclosed within the transparent material with a transparent medium. In certain exemplary embodiments of the method, the gift is a gift card and the storage cavity has a size and shape configured to receive and store the gift card.

These and other aspects, features and advantages of the invention or of certain embodiments of the invention will be further understood by those skilled in the art from the following description of exemplary embodiments.

BRIEF DESCRIPTION OF THE DRAWINGS

Exemplary embodiments of the disclosure will now be described by way of example only and with reference to the accompanying drawings, in which.

DETAILED DESCRIPTION OF EMBODIMENTS

The embodiments, apparatuses and methods described herein provide packaging that can serve as a stand-alone, aesthetically pleasing container or a method of packaging using such materials. These may serve as a reminder or an allusion for a gift or the occasion where a gift was granted. These and other aspects, features and advantages of the invention or of certain embodiments of the invention will be further understood by those skilled in the art from the following description of exemplary embodiments.

Figure 1:
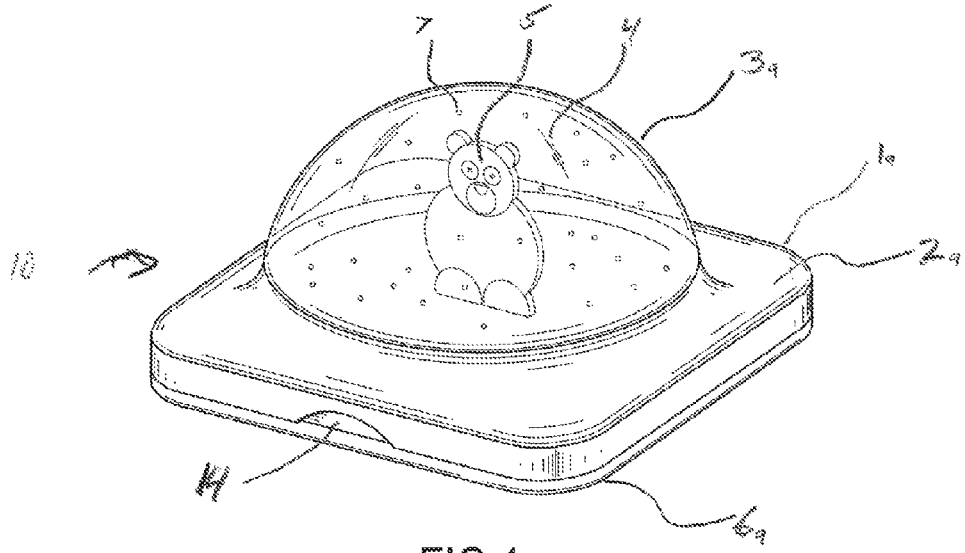
FIG. 1 shows an exemplary embodiment of the packaging container with the lid in the closed position.

FIG. 1 shows an exemplary embodiment of the packaging container. In this embodiment, the packaging container 10 comprises a lid 1*a* with an exterior surface 2*a*. In some embodiments, the lid is made from plastic, metal, wood, glass, ceramic, stone, fabricated stone, or a combination thereof. The lid la is substantially square shaped with rounded edges, in this embodiment, while in other embodiments the lid is other geometric or non-geometric shapes. In this exemplary embodiment, the exterior surface 2*a* is substantially flat, while in others it is be partially or entirely curved or otherwise textured. In this example, a transparent material 3*a* shaped like a portion of a sphere is mounted on top of part of the exterior surface of the lid. In other embodiments the transparent material is shaped as part of or all of an ellipse, square, rectangle, or another geometric or non-geometric shape. In some embodiments, the transparent material is glass. In yet other embodiments it is made of plastic.

In the example embodiment provided by FIG. 1, the transparent material 3*a* encloses an interior space that is filled by a transparent medium 4 and is configured to house at least one article of artwork 5. In certain embodiments, the transparent medium will fill all of the remaining entire interior space that is not occupied by articles of artwork, and optionally other objects, contained inside the interior space, while in others the transparent medium will fill substantially all of the remaining interior space. As used herein, "substantially all of the remaining interior space" refers to at least about 90% of the remaining interior space, such as at least about 95% of the remaining interior space or at least about 98% of the remaining interior space. In some embodiments the transparent material is made of is water, oil, glycerine or a combination thereof in certain embodiments, including the example provided by FIG. 1, a plurality of particles 7 are contained within the transparent medium that can selectively be dispersed throughout the transparent medium. In some embodiments the particles 7 can be dispersed throughout the transparent medium through mechanical action or agitation involving the packaging container, while in others a motor or pump is used to agitate the transparent medium on a periodic or continuous basis. In some embodiments the particles are made of plastic, porcelain or metallic foil such as gold foil. In other embodiments the particles are made of soap flakes, bone chips, sand or sawdust.

In this example, an article of artwork 5 is positioned inside the interior space enclosed by the transparent material 3*a*. In some embodiments, the article of art is affixed to a surface on the bottom of the interior space, where in certain embodiments the bottom of the interior space is part of the lid, such as the exterior surface of the lid or on an additional piece affixed on top of the exterior surface, or part of the transparent material. In the artwork 5 embodiment shown in FIG. 1, the article of artwork 5 is affixed to the lid of the packaging container on the bottom of the interior space. In yet other embodiments the article of artwork 5 is allowed to move freely throughout the transparent medium 4, while in others it is affixed to a side or top of the transparent material. In certain embodiments the article of artwork 5 is selected from a figure, a photograph or a representation of a landscape. In some embodiments the figure is made of ceramic, while in others it is made of plastic. In other embodiments the article of artwork 5 is a flat or substantially two dimensional object, while in others it is a three dimensional object. In still other embodiments there are multiple articles of artwork 5. In the embodiment of FIG. 1, a base 6*a* is disposed beneath the lid 1*a* such that a portion of the base 6*a* meets the interior surface of the lid 1*a*. In certain embodiments the base has substantially the same shape as the lid, while in other embodiments it has a different size or shape. In some embodiments the lid is made from plastic, metal, wood, glass, ceramic, stone, fabricated stone, or a combination thereof.

Figure 2:
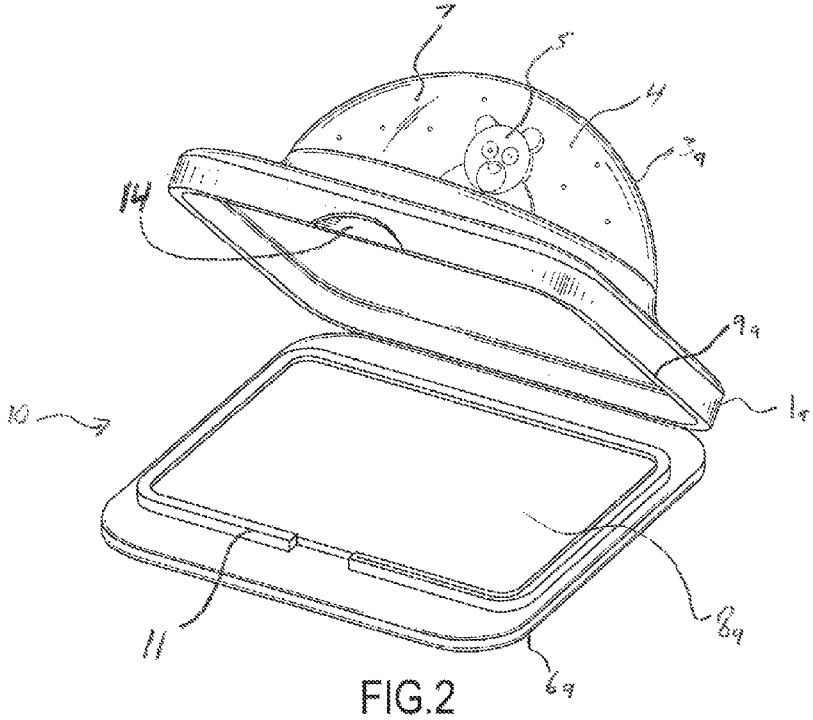
FIG. 2 shows the same exemplary embodiment as in FIG. 1, with the lid open, showing the storage cavity of the base.

FIG. 2 shows the exemplary embodiment of FIG. 1 with the lid 1*a* open, showing an interior edge 9*a* that meets the base 6*a*. In this example the lid includes a notch 14 to allow a user to open the lid more easily, while other embodiments include an extension of or protrusion from the lid to assist opening. In this example, a portion of the base 6*a* defines a storage cavity 8*a*, where the storage cavity 8*a* is defined by a raised border 11. The raised border 11 further acts as a portion of the base 6*a* to meet the interior of the lid 1. In this example, the storage cavity 8*a* has a size and shape configured to receive and store a gift card. In other embodiments the storage cavity 8*a* is defined by a recess in the base 6*a*. Further, in other embodiments, the storage cavity 8*a* has a size and shape configured to receive different goods or a range of goods with various shapes and sizes.

In some exemplary embodiments of the invention, the storage cavity has a size and shape configured to receive and store a gift card. In certain of these embodiments, the article of artwork indicates the type of goods or services provided by a gift card, for example by a gift card contained inside the storage cavity 8. In yet other embodiments, the article of artwork indicates the brand or store name from which a gift card originates. Such a gift card can then be placed inside the storage cavity at the time of manufacture or later by a person. In still other embodiments, the article of artwork is related to the theme of an occasion, for instance the occasion where the packaging container is given to a recipient. Suitable occasions include for example and without limitation, birthdays, anniversaries, religious holidays, graduations, promotions, championships, particular accomplishments, and specific calendar days (e.g., Mother's Day, Valentine's Day, Christmas, etc.).

In other embodiments, the storage cavity has a size and shape configured to receive and store one or more goods and wherein the article of artwork indicates the type of goods contained inside the storage cavity, indicates a brand or store name or is related to the theme of an occasion.

In certain embodiments, the storage cavity has a size and shape configured to receive and store paper currency. In still other embodiments the base includes a writeable surface attached to a surface of the base or the storage cavity. In these embodiments, a person may write or inscribe a personal message on the writeable surface. In certain of these embodiments the writeable surface is made of paper or cardboard.

Figure 3:
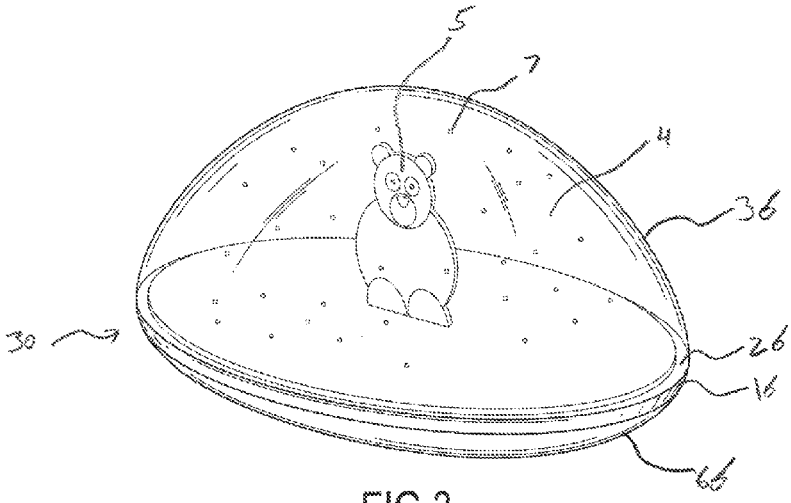
FIG. 3 shows another exemplary embodiment of the packaging container with the lid in the closed position.
Figure 4:
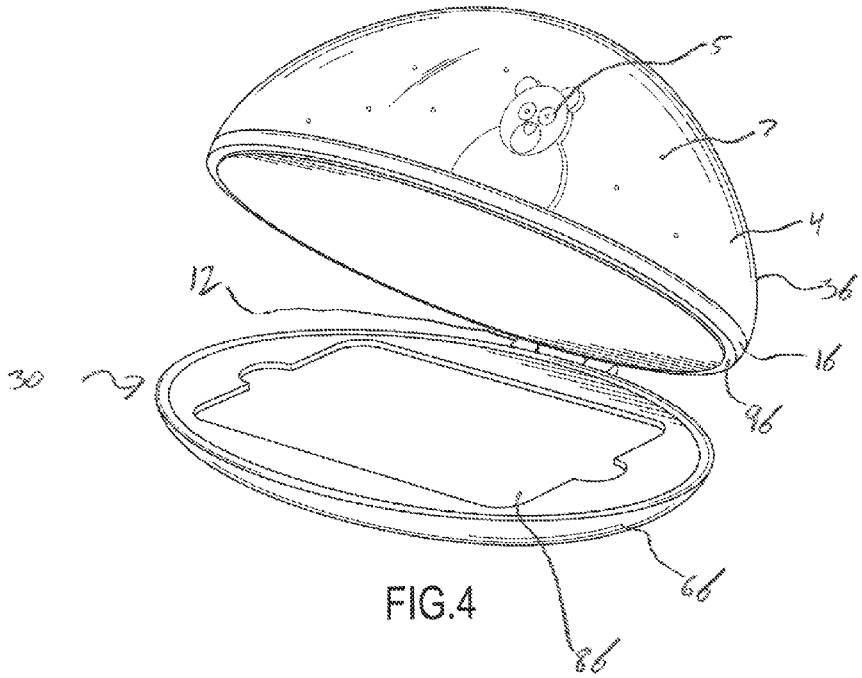
FIG. 4 shows the same exemplary embodiment as in FIG. 3, with the lid open, showing the storage cavity of the base.

FIG. 3 shows another exemplary embodiment of a packaging container 30 according to the invention. In this example, the transparent material 3*b* covers the entire exterior surface 2*b* of the lid 1*b*. In this example, transparent material defines an interior shape similar to a portion of an ellipse. FIG. 4 shows the exemplary embodiment of FIG. 3 with the lid 1*b* open. In this exemplary embodiment, the storage cavity 8 is defined by a recess in the base 6*b*. The storage cavity 8*b* has a size and shape configured to receive and store a gift card and the base 6*b* is substantially shaped like an ellipse. This exemplary embodiment also includes an opener 12 connecting the lid 1*b* and base 6*b*. In this exemplary embodiment the opener is a hinge that allows the lid 1*b* to be rotated away from the base 6*b*. In other embodiments the opener is a bearing or flexure bearing that allows opening of the packaging container 30. In still other embodiments, the opener is a sliding mechanism using grooves or rails that allows the lid to be slid away from the base to reveal the storage cavity. In certain embodiments, the opener is made of metal, plastic, or a combination thereof.

Figure 5:
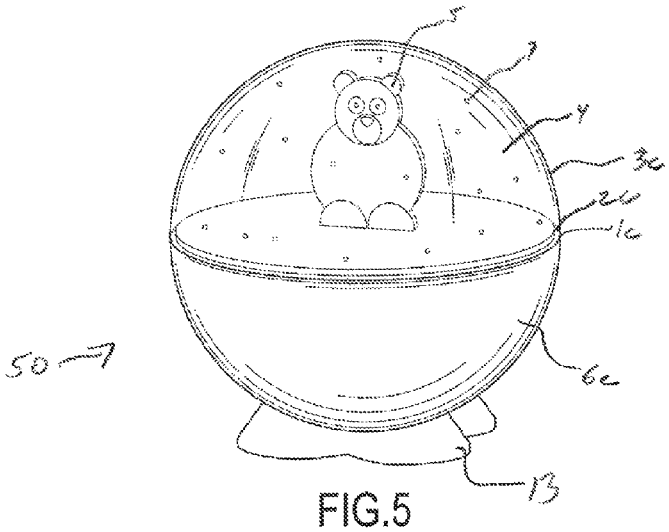
FIG. 5 shows a further exemplary embodiment of the packaging container with the lid in the closed position.
Figure 6:
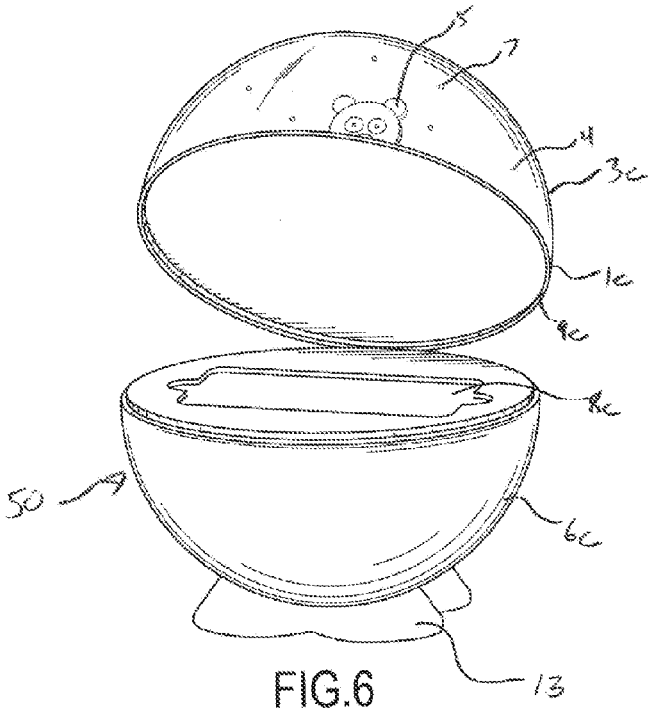
FIG. 6 shows the same exemplary embodiment as in FIG. 5, with the lid open, showing the storage cavity of the base.

FIG. 5 shows another exemplary embodiment of a packaging container 50 according to the invention where both the transparent material 3*c* and the base 6*c* are rounded and shaped like portions of a sphere. In this embodiment, the base includes a separate stand 13. FIG. 6 shows the exemplary embodiment of FIG. 5 with the lid 1*c* open.

These apparatus descriptions are merely exemplary. In certain embodiments, the apparatus comprises additional combinations or substitutions of some or all of the components described above. Moreover, additional and alternative suitable variations, forms and components fir the apparatus will be recognized by those skilled in the art given the benefit of this disclosure.

Other aspects of the invention relate to a method for packaging gifts. In some exemplary embodiments, the method includes placing a gift in a storage cavity of a packaging container, where the packaging container comprises a lid comprising an exterior surface and an interior surface, a transparent material mounted on top of at least part of the exterior surface of the lid that encloses an interior space configured to house at least one article of artwork, and a base disposed below the lid, wherein a portion of the base meets the interior surface of the lid, and wherein at least a portion of the base defines the storage cavity, positioning an article of artwork inside the interior space enclosed within the transparent material, wherein the article of artwork indicates the type of goods or services provided by the gift, indicates the brand or store name from which the gift originates or is related to the theme of an occasion, and filling substantially all or all of the remaining interior space enclosed within the transparent material with a transparent medium. In some embodiments the gift is placed in the storage cavity at the time of manufacture for the packaging container. In other embodiments the gift is placed in the storage cavity at a later time. In certain other exemplary embodiments of the method, the gift is a gift card and the storage cavity has a size and shape configured to receive and store the gift card.

These method descriptions are merely exemplary. In certain embodiments, the method may include additional combinations or substitutions of some or all of the steps described above. Moreover, additional and alternative suitable variations, forms and components for the method will be recognized by those skilled in the art given the benefit of this disclosure.

What is claimed is:

1. A gift packaging container comprising:

a lid comprising an exterior surface and an interior surface;

a transparent material mounted on top of at least part of the exterior surface of the lid, wherein some or all of the transparent material is spherically shaped such that it encloses an interior space that is at least in part spherical in shape, and wherein the interior space is configured to house at least one article of artwork;

an article of artwork positioned inside the interior space enclosed by the transparent material, wherein the article of artwork indicates a type of goods or services, a brand or store name or is related to the theme of an occasion;

a liquid transparent medium filling substantially all or all of the remaining interior space enclosed within the transparent material;

a base disposed below the lid, wherein a portion of the base meets the interior surface of the lid and wherein at least a portion of the base defines a storage cavity having a size and shape configured to receive and store a gift card;

a writeable surface attached to a surface of the base or a surface of the storage cavity; and a hinge or bearing connecting the lid and base.

* * * * *